US006857135B2

(12) United States Patent
Sumitomo

(10) Patent No.: US 6,857,135 B2
(45) Date of Patent: Feb. 22, 2005

(54) HELMET

(76) Inventor: Yoshiyuki Sumitomo, 2-3-2, Sekime, Jyoto-ku, Osaka-shi, Osaka 536-0008 (JP)

( * ) Notice: Subject to any disclaimer, the term of this patent is extended or adjusted under 35 U.S.C. 154(b) by 0 days.

(21) Appl. No.: 10/453,688

(22) Filed: Jun. 4, 2003

(65) Prior Publication Data

US 2004/0244098 A1 Dec. 9, 2004

(51) Int. Cl.[7] ..... A42B 1/06
(52) U.S. Cl. ..... 2/410; 2/171.3
(58) Field of Search ..... 2/171.3, 411, 410, 2/424, DIG. 5, 184.5

(56) References Cited

U.S. PATENT DOCUMENTS 585,186 A * 6/1897 Cross ..... 2/181.6
735,790 A * 8/1903 Meerza ..... 2/171.3
2,131,617 A * 9/1938 Cowden ..... 2/411
3,223,086 A * 12/1965 Denton ..... 128/201.24
3,496,854 A * 2/1970 Hill et al. ..... 454/370
4,028,739 A * 6/1977 Bell et al. ..... 2/6.3
5,010,598 A * 4/1991 Flynn et al. ..... 2/410
5,734,994 A * 4/1998 Rogers ..... 2/411
5,829,065 A * 11/1998 Cahill ..... 2/418
5,940,889 A * 8/1999 Shirai ..... 2/411

FOREIGN PATENT DOCUMENTS

FR 2713049 A3 * 6/1995 ..... A42B/03/04
GB 2307842 A * 6/1997 ..... A42B/03/28
JP 2002161426 A * 6/2002 ..... A42B/03/28
WO WO 9105489 A1 * 5/1991 ..... A42B/03/12

* cited by examiner

*Primary Examiner*—Rodney M. Lindsey
(74) *Attorney, Agent, or Firm*—Arent Fox PLLC

(57) ABSTRACT

In a helmet, a helmet body 1 has ventilation holes 3 formed therein, and a guard portion 2*a* is arranged outside the helmet body 1 so as to cover the portion thereof where the ventilation holes 3 are formed. The guard portion 2*a* has a gap 5 for ventilation secured toward the outer surface of the helmet body 1 and the ventilation holes 3.

8 Claims, 4 Drawing Sheets

HELMET

BACKGROUND OF THE INVENTION

1. Field of the Invention

The present invention relates to a helmet, and more particularly to a helmet having a ventilation hole formed therein.

2. Description of the Prior Art

FIG. 7 is a perspective view of an example of a conventional, common helmet, and FIG. 8 is a perspective view of the helmet shown in FIG. 7 with ventilation holes 101 additionally formed therein. A helmet without ventilation holes, like that shown in FIG. 7, has the disadvantage of tending to contain heat and moisture inside it. On the other hand, a helmet with ventilation holes 101, like that shown in FIG. 8, has the disadvantage of being less safe, because the ventilation holes 101 diminish the mechanical strength of the portion of the helmet where they are formed and because the ventilation holes 101 allow a falling object to pass therethrough and directly hit the head of the wearer, and also has the disadvantage of allowing rain to enter the helmet through the ventilation holes 101.

SUMMARY OF THE INVENTION

The present invention has been devised in view of the above drawbacks of conventionally structured helmets, and it is an object of the present invention to provide a helmet that offers satisfactory ventilation and safety simultaneously and that is so structured as not to allow entry of rain into the helmet easily.

To achieve the above object, according to one aspect of the present invention, a helmet is provided with: a helmet body having a ventilation hole formed therein; and a guard portion arranged outside the helmet body so as to cover the portion of the helmet body where the ventilation hole is formed and protect the portion from externally applied impact. Here, the guard portion has a gap for ventilation secured toward the outer surface of the helmet body and the ventilation hole.

With this structure, the heat and moisture inside the helmet body flow out of it through the ventilation hole, and simultaneously outside air flows into the helmet body through the ventilation hole. This prevents heat and moisture from being contained inside the helmet body. Moreover, the portion of the helmet body where the ventilation hole is formed is protected by the guard portion. This enhances resistance to impact, and prevents a falling object from passing through the ventilation hole. Thus, it is possible to achieve higher safety. Furthermore, the ventilation hole is covered by the guard portion. This prevents easy entry of rain into the helmet body through the ventilation hole.

For satisfactory ventilation, it is preferable that the guard portion be located 1 mm or more apart from the ventilation hole.

It is preferable that the ventilation hole be formed in a top portion of the helmet body. This, in particular, prevents easy entry of rain into the helmet body.

It is preferable that the guard portion be resilient so as to be capable of bending closer to the ventilation hole while being increasingly loaded with resilience that tends to bring the guard portion back to the original position thereof. This permits impact applied from outside the guard portion to be absorbed to a certain degree by the resilience of the guard portion, and thus helps alleviate the impact that reaches the head of the wearer.

It is preferable that an elastic member that is elastically deformed against the guard portion as the guard portion bends be arranged in the gap. This helps further alleviate the impact that reaches the head of the wearer.

It is preferable that a portion of the outer surface of the helmet body around the ventilation hole be elevated so as to surround the ventilation hole. This makes it more difficult for rain to enter the helmet body.

BRIEF DESCRIPTION OF THE DRAWINGS

This and other objects and features of the present invention will become clear from the following description, taken in conjunction with the preferred embodiments with reference to the accompanying drawings in which.

DESCRIPTION OF THE PREFERRED EMBODIMENTS

Figure 1:
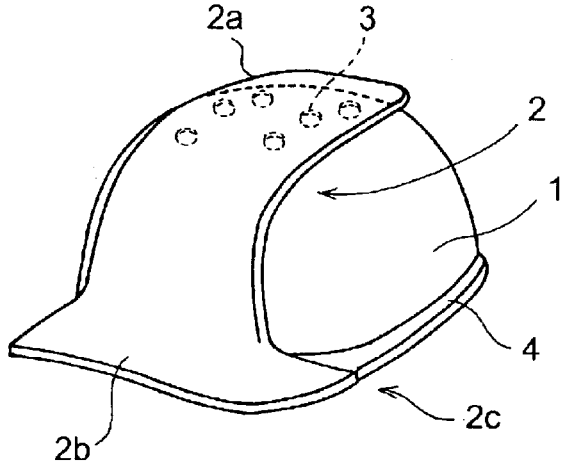
FIG. 1 is a perspective view of a helmet embodying the invention.
Figure 2:
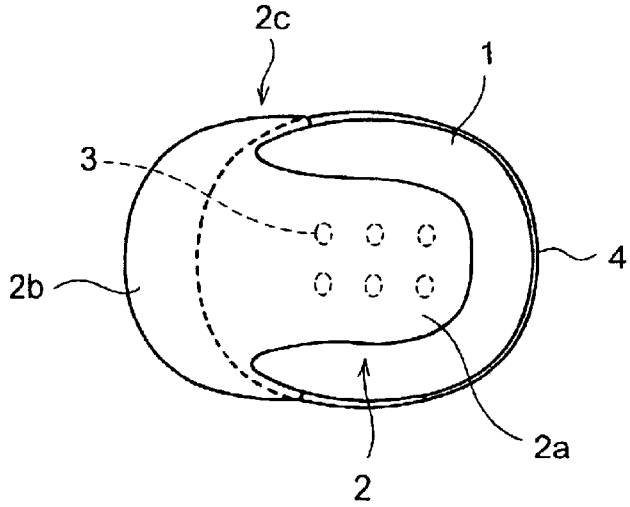
FIG. 2 is a plan view of the helmet shown in FIG. 1.
Figure 3:
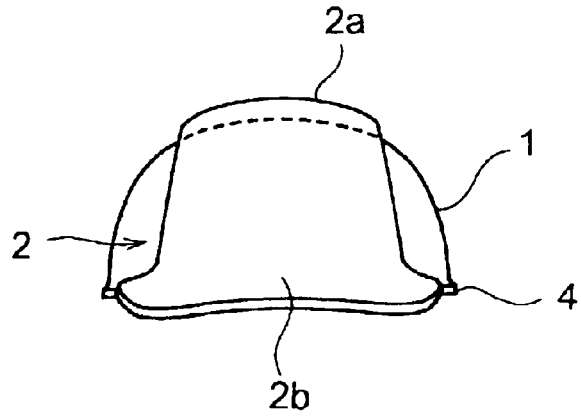
FIG. 3 is a front view of the helmet shown in FIG. 1.
Figure 4:
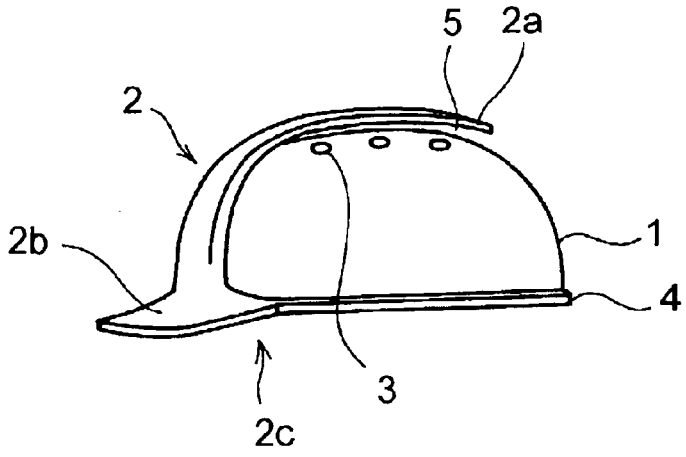
FIG. 4 is a side view of the helmet shown in FIG. 1.
Figure 5:
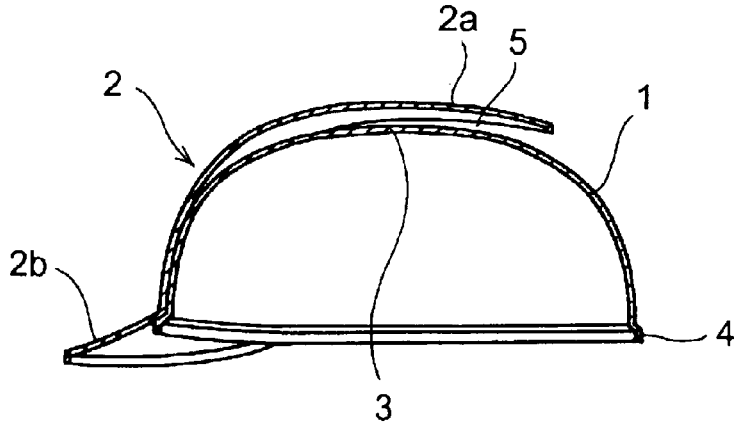
FIG. 5 is a side sectional view of the helmet shown in FIG. 1.

Hereinafter, helmets embodying the present invention will be described with reference to the drawings. FIG. 1 is a perspective view of a helmet embodying the invention, FIG. 2 is a plan view of the helmet shown in FIG. 1, FIG. 3 is a front view of the helmet shown in FIG. 1, FIG. 4 is a side view of the helmet shown in FIG. 1, and FIG. 5 is a side sectional view of the helmet shown in FIG. 1.

The helmet of this embodiment is shaped like a cap with a visor portion 2*b*. This helmet is provided with a helmet body 1 shaped like a hollow dome and an impact-absorbing plate 2 arranged outside the helmet body 1, both formed of a plastic having appropriate rigidity.

The helmet body 1 is formed so as to cover the upper half of the head of the wearer, and has a plurality of ventilation holes 3 formed in a top portion thereof. Moreover, the helmet body 1 has a flange 4 formed at the bottom end thereof so as to project sideways from all around the circumference thereof.

On the other hand, the impact-absorbing plate 2 is composed of a guard portion 2*a* shaped like a tongue so as to extend rearward along a front and a top portion of the outer surface of the helmet body 1, a visor portion 2*b* projecting frontward from a front portion of the helmet body 1, and a fitting portion 2*c* formed at that end of the visor portion 2*b* closer to the helmet body 1. By firmly fitting the fitting portion 2*c* to a front portion of the flange 4 by bonding them together or otherwise, the impact-absorbing plate 2 is fitted to the helmet body 1.

As shown in FIG. 5, the guard portion 2*a* is located apart from the outer surface of the helmet body 1 except in a front end portion of the former so as to form a gap 5 for securing ventilation on that side of the guard portion 2*a* toward the outer surface of the helmet body 1 and the ventilation holes 3 and simultaneously cover the ventilation holes 3. For satisfactory ventilation, it is preferable that the guard portion 2*a* be located 1 mm or more apart from the ventilation holes 3. For a respectable outward appearance and for effective prevention of entry of rain, it is preferable that the guard portion 2*a* be located from about 5 mm to about 8 mm apart from the ventilation holes 3.

Moreover, the guard portion 2*a* is made flexible so as to be capable of bending, with its front-end portion serving as a fulcrum, closer to the ventilation holes 3 while being increasingly loaded with resilience that tends to bring the guard portion 2*a* back to its original portion.

Structured as described above, the helmet of this embodiment allows the heat and moisture inside the helmet body 1 to flow out of it through the ventilation holes 3, and simultaneously allows outside air to flow into the helmet body 1 through the ventilation holes 3 by way of the gap 5. This prevents heat and moisture from being contained inside the helmet body 1.

Moreover, this helmet has a double-layered structure in which the portion of the helmet body 1 where the ventilation holes 3 are formed is covered by the guard portion 2*a*. This not only increases mechanical strength, but also allows the guard portion 2*a* to bend downward when impact is applied from above, permitting the resulting resilience to absorb the impact to a certain degree and thereby alleviate the impact that reaches the head of the wearer. Furthermore, the presence of the guard portion 2*a* over the ventilation holes 3 eliminates the risk of a falling object passing through the ventilation holes 3 and directly hitting the head of the wearer. This enhances safety.

Moreover, since the ventilation holes 3 are covered by the guard portion 2*a*, rain does not enter the helmet body 1 easily. In particular where, as in this embodiment, the ventilation holes 3 are formed in a top portion of the helmet body 1, the guard portion 2*a* is located over the ventilation holes 3, and, since rain falls largely from right above, this makes it more difficult for rain to enter the helmet body 1 than where the ventilation holes 3 are formed elsewhere.

It is to be understood that the present invention can be carried out in any other manner than specifically described above as an embodiment, and many modifications and variations are possible as exemplified below.

Although the ventilation holes 3 are formed in a top portion of the helmet body 1 in the embodiment described above, they may be formed elsewhere than in a top portion.

By providing in the gap 5 an elastic member that is elastically deformed against the guard portion 2*a* as it bends, it is possible to further alleviate the impact that reaches the head of the wearer. Examples of such an elastic member include sponge, rubber, and springs. It is preferable that the elastic member be gas-permeable.

Although the guard portion 2*a* is so formed as to bend when external impact is applied in the embodiment described above, it may be made highly rigid so as not to bend on application of impact.

The guard portion 2*a* does not necessarily have to be fitted in a front portion of the helmet body 1; it may be fitted anywhere in a peripheral portion of the helmet body 1, such as in a side or rear portion thereof. The guard portion 2*a* may be formed integrally with the helmet body 1.

Figure 6:
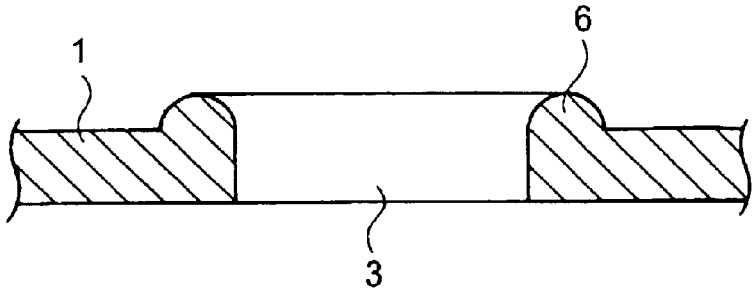
FIG. 6 is a sectional view of a principal portion of the helmet body, with an elevated portion formed so as to surround the ventilation hole.
Figure 7:
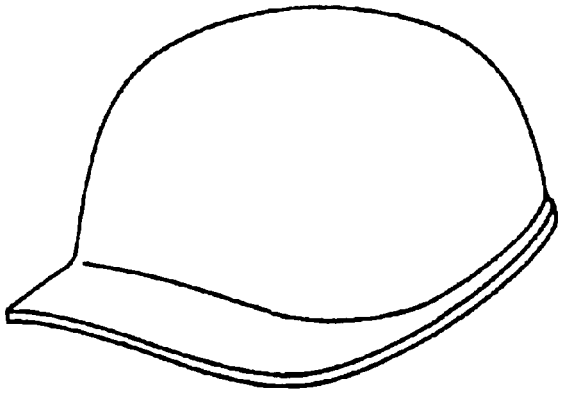
FIG.7 (PRIOR ART)
FIG. 7 is a perspective view of an example of a conventional, common helmet.
Figure 8:
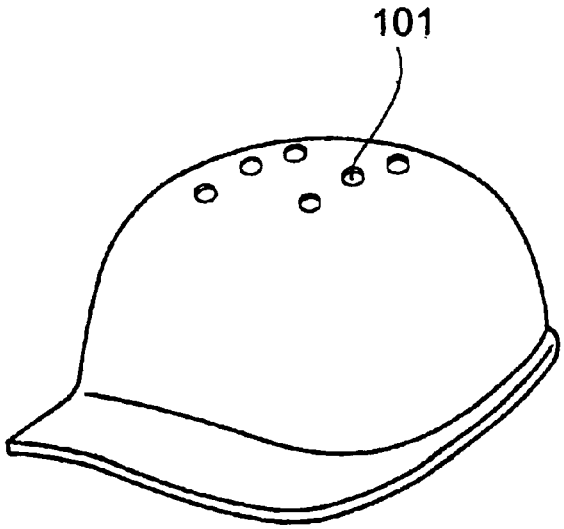
FIG.8 (PRIOR ART)
FIG. 8 is a perspective view of the helmet shown in FIG. 7 with ventilation holes additionally formed therein.

As shown in FIG. 6, a ring-shaped elevated portion 6 may be formed in a portion of the outer surface of the helmet body 1 around each ventilation hole so as to surround the ventilation hole. This prevents easy entry into the ventilation holes 3 of rain flowing along the outer surface of the helmet body 1, and thus makes it more difficult for rain to enter the helmet body 1.

It is to be understood that many other modifications and variations are possible in the embodiment described above within the scope of the present invention.

What is claimed is:

1. A helmet comprising:

a helmet body having a ventilation hole formed therein; and a guard portion arranged outside said helmet body so as to cover a portion of said helmet body where said ventilation hole is formed and protect said portion from externally applied impact, wherein said guard portion has a cap for ventilation secured toward an outer surface of said helmet body and said ventilation hole, and wherein said guard portion is resilient so as to be capable of bending closer to said ventilation hole while being increasingly loaded with resilience that tends to bring said guard portion back to an original position thereof.

2. The helmet according to claim 1, wherein said guard portion is located 1 mm or more apart from said ventilation hole.

3. The helmet according to claim 1, wherein said guard portion is located from 5 mm to 8 mm apart from said ventilation hole.

4. The helmet according to claim 1, wherein said ventilation hole is formed in a top portion of said helmet body.

5. The helmet according to claim 1, wherein a portion of an outer surface of said helmet body around said ventilation hole is elevated so as to surround said ventilation hole.

6. A helmet comprising:

a helmet body having a ventilation hole formed therein; and an impact-absorbing member having a guard portion that covers said ventilation hole with a gap secured in between and a fitting portion by which said impact-absorbing member is fitted on said helmet body, wherein said guard portion is resilient so as to be capable of bending closer to said ventilation hole while being increasingly loaded with resilience that tends to bring said guard portion back to an original position thereof.

7. The helmet according to claim 6, wherein said ventilation hole is formed in a top portion of said helmet body, wherein said impact-absorbing member is fitted on a peripheral portion of said helmet body by said fitting portion; and wherein said guard portion is shaped like a tongue so as to extend from the peripheral to the top portion of said helmet body.

8. The helmet according to claim 6, wherein the impact-absorbing member further has a visor portion.

* * * * *